United States Patent [19]

Crisci

[11] Patent Number: 4,589,561

[45] Date of Patent: May 20, 1986

[54] TAMPER-PROOF CLOSURE FOR CONTAINERS

[75] Inventor: Clem C. Crisci, New Castle, Pa.

[73] Assignee: Northern Engineering and Plastics Corp., New Castle, Pa.

[21] Appl. No.: 690,850

[22] Filed: Jan. 11, 1985

[51] Int. Cl.[4] ..... B65D 41/46

[52] U.S. Cl. ..... 215/256

[58] Field of Search ..... 215/256, 295, 217

[56] References Cited

U.S. PATENT DOCUMENTS

| | | | |
|---|---|---|---|
| 3,120,900 | 2/1964 | Faulstich | 215/256 |
| 3,695,475 | 10/1972 | Ruekberg | 215/217 |
| 3,893,583 | 7/1975 | McLaren | 215/256 |
| 4,037,746 | 7/1977 | Ver Hage | 215/256 X |
| 4,066,182 | 1/1978 | Allen et al. | 215/256 |
| 4,202,455 | 5/1980 | Faulstich | 215/256 X |
| 4,307,821 | 12/1981 | McIntosh | 215/256 |

*Primary Examiner*—Donald F. Norton
*Attorney, Agent, or Firm*—Harpman & Harpman

[57] ABSTRACT

A closure for a container such as a blow molded jug having a neck surrounding an opening therein and a pair of vertically spaced fastening configurations on the exterior thereof, the closure having a cap portion and an annular tear skirt depending therefrom, the tear skirt having a pull tab for the removal thereof, the cap portion having an annular flange therein and the tear skirt having an annular groove therein and a second annular groove spaced with respect thereto defining a frangible wall joining the cap portion and the tear skirt. The annular flange in the cap portion seats under one of the fastening configurations on the neck of the container and one of the annular grooves in the closure receives the other fastening configuration on the neck of the container to form dual fasteners, either one of which is capable of holding the closure on the neck portion of the container.

3 Claims, 5 Drawing Figures

TAMPER-PROOF CLOSURE FOR CONTAINERS

BACKGROUND OF THE INVENTION

1. Technical Field

This invention relates to tamper-proof closures for containers, such as blow molded plastic jugs which are widely used in the dairy industry for the expendible packaging of dairy products, such as milk.

2. Description of the Prior Art

Prior closures of this type may be seen in U.S. Pat. Nos. 3,893,583, 4,037,746, 4,066,182 and 4,202,455.

The present invention provides a novel dual fastening of a molded plastic tamper-proof closure in that the closure includes a top portion with a depending annular flange having a first fastening configuration therein with a second fastening configuration formed in a tear skirt depending from the annular depending flange of the cap portion of the closure.

SUMMARY OF THE INVENTION

A tamper-proof closure for containers, such as blow molded jugs with appropriate neck configurations, takes the form of a cap portion having a top and an annular depending flange on its peripheral edge radially spaced with respect to an annular sealing flange. An inturned fastening flange is formed on the inner surface of the annular depending flange of the cap portion adjacent an area of larger diameter in which a first annular groove is formed in the inner surface thereof so as to define a thin, frangible connection with the remaining portion of the depending annular flange which forms a tear skirt. A second annular groove is formed in the tear skirt and forms a second fastening configuration. A pull tab is integrally formed with the tear skirt and a diagonal groove is formed in the tear skirt adjacent the pull tab leading from the peripheral edge of the tear skirt to the first annular groove and the thin frangible connection defined thereby.

If desired, a plurality of angularly disposed ribs may be formed on the inner surface of the tear skirt for registry with similar ribs formed on the neck portion of a container if an alternate twist-off separation feature is desired.

DESCRIPTION OF THE PREFERRED EMBODIMENT

Figure 4:
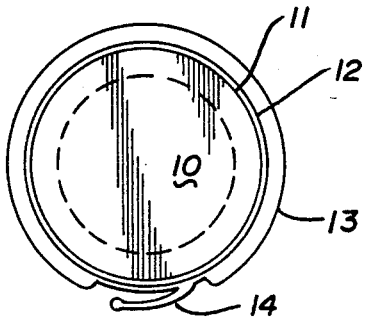
FIG. 4 is a top plan view of the tamper-proof closure showing the pull tab.
Figure 5:
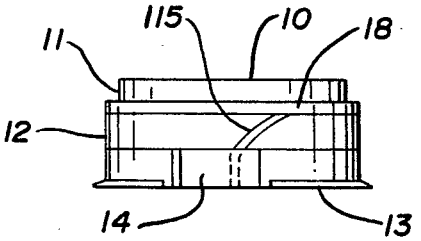
FIG. 5 is a side elevation of the tamper-proof closure showing the pull tab and a diagonal tear groove in the tear skirt.

By referring to the drawings and FIGS. 4 and 5 in particular, a top plan view and a side elevation of the tamper-proof closure may be seen, the closure including a top portion 10 with a depending annular flange of different diameters, one of which forms a relatively short first portion 11 and the other forms a larger diameter portion of the depending annular flange 12, the lower edge of which has an outturned angular flange 13 formed on a majority of its annular lower edge. A pull tab 14 is attached to the depending annular flange 12 in the area between the ends of the outturned angular flange 13. As illustrated in FIG. 5 of the drawings, the portion 12 of the depending annular flange which is of larger diameter than the portion 11 is provided with a tear groove 115.the lower portion of which extends substantially vertically alongside the end of the pull tab 14 and the upper portion of which runs at an angle with respect thereto upwardly to an annular groove in the depending annular flange 12 and just below the point of enlargement thereof with respect to the first portion 11 of the depending flange.

Figure 1:
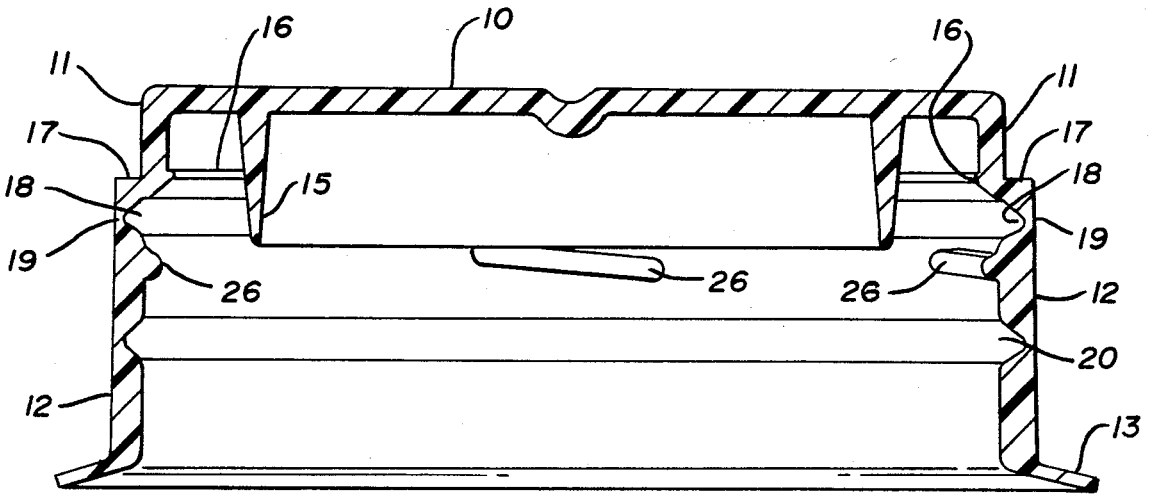
FIG. 1 is a vertical section of the tamper-proof closure.

By referring to FIG. 1 of the drawings, an enlarged vertical section of the tamper-proof closure may be seen to comprise the circular, relatively flat top portion 10, the relatively short first portion 11 of the annular flange 12 which depends from the peripheral edge of the top portion 10 together with the outturned angular flange 13 and it will be observed that there is an annular sealing flange 15 which is tapered in thickness that depends from the circular, relatively flat top portion 10 radially spaced inwardly from the first portion 11 of the depending flange 12. The first portion 11 of the depending flange will be observed to be of smaller diameter than the remainder of the depending annular flange 12 and that it is provided with an inturned flange 16 which forms a first fastening flange. An outturned flange 17 defines the difference in diameters of the first portion 11 and the remainder of the depending annular flange 12 and the inturned annular fastening flange 16 is oppositely disposed with respect to the outturned flange 17. The exterior annular surface of the depending annular flange 12 below the outturned flange 17 is formed on a substantially vertical plane and of an increased wall thickness with respect to the wall thickness of the first portion 11 and the circular, relatively flat top portion 10 of the tamper-proof closure.

There is a first annular groove 18 in the depending annular flange 12 just below the outturned flange 17, the annular groove 18 being sufficiently deep that it creates a thin, frangible connecting wall 19 and thereby defines the tear skirt which comprises all of the depending annular flange 12 below the annular groove 18. There is a second annular groove 20 in the depending annular flange 12 which forms a second fastening configuration.

Figure 2:
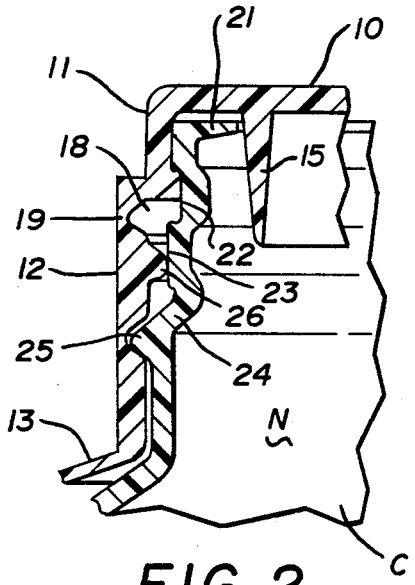
FIG. 2 is a vertical section through a portion of the tamper-proof closure and a portion of a neck of a container on which the closure is applied showing the dual fastening means.

By referring now to FIG. 2 of the drawings, a portion of a container C having a neck N may be seen, the configuration of the neck N having an inturned tapered top flange 21, an annular flat shallow groove 22 on the exterior thereof and spaced downwardly with respect to the upper end of the neck portion of the container, an annular flat wall section 23 immediately therebelow, the lower portion of which joins an outwardly angling section 24 which extends into an annular rib 25. The annular rib 25 and the flat shallow groove 22 of the neck portion of the container form two fastening configurations which register with the second annular groove 20 and the inturned fastening flange 16 respectively of the closure. It will be seen that simply pushing the closure downwardly on the neck N of the container C brings the dual fastening configurations just described into interlocking relation thus securely positioning the closure on the container neck. At the same time, the annular sealing flange 15 on the closure registers with the central opening defined by the tapered top flange 21 of the neck N of the container.

Figure 3:
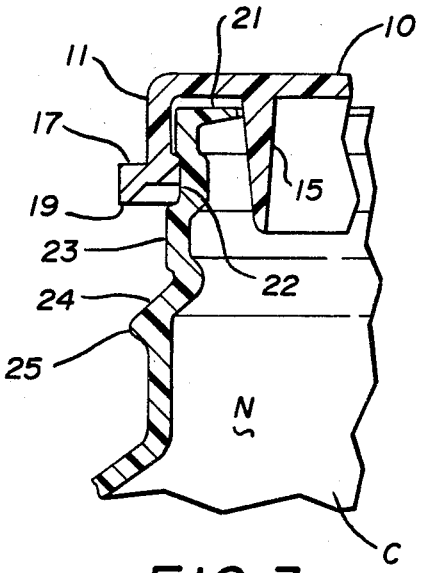
FIG. 3 is a vertical section through a portion of the tamper-proof closure after the tear skirt has been removed and showing the same on a portion of the neck of a container in sealing relation.

By referring now to FIG. 3 of the drawings, a vertical section of a portion of the container C and neck N thereof may be seen with the upper portion of the tamper-proof closure positioned thereon in sealing relation.

In FIG. 3 of the drawings, the majority of the depending flange 12 has been removed leaving the circular, relatively flat top 10 with the first portion 11 of the depending annular flange thereon including the outturned flange 17 and the inturned fastening flange 16, which is illustrated in engagement with the upper portion of the flat, shallow groove 22 of the neck portion, the engagement of the tapered annular sealing flange 15 with the inner peripheral edge of the tapered inwardly extending top flange 21 of the neck portion 15 being maintained. The engagement of the inturned fastening flange 16 of the closure with the upper portion of the flat shallow groove 22 of the neck portion N is sufficient to hold the closure as shown in FIG. 3 on the container at all times including dropping a container of a one-gallon size filled with liquid, such as milk, on a hard surface, such as a floor, from an elevated height. The proximity of the fastening configuration thus defined to the tapered annular sealing flange 15 limits the distortion of the closure and thus insures a liquid tight seal which is so highly desirable when the closure in its abbreviated form is replaced on the container.

It will be seen that when the tamper-proof closure disclosed herein is positioned downwardly on the neck of a container such as a blow molded plastic jug, the dual fastening configurations snap into position simultaneously and without interfering with one another. As the cap is moved downwardly over the neck N of the container, the major portion of the annular depending flange 12 is spaced outwardly or radially of the flat shallow groove 22 and the annular flat wall 23 of the neck portion N so that they do not engage the same, but move downwardly freely until the annular groove 20, which comprises the second fastening configuration, registers with the annular rib 25 of the neck portion N of the container. Simultaneously, the upper portion of the closure has moved downwardly until the inturned annular fastening flange 16 snaps inunder the portion of the neck N defining the upper part of the flat shallow groove 22. The additional material and increased wall thickness of the closure beneath the outturned flange 17 and substantially opposite the inturned annular fastening flange 16 insures the effective and tight snap-in arrangement of the inturned annular fastening flange 16 in the upper portion of the flat shallow groove 22 of the neck portion N. The closure is formed of resilient molded plastic material.

It will occur to those skilled in the art that in order to remove the closure from the neck of the container, it is necessary to grasp the pull tab 14 as shown in FIG. 4 of the drawings and move it from left to right which causes the lower portion of the depending annular flange 12 of the closure which forms the tear skirt to separate on the line of the groove 18 which is formed in the inner surface of the depending flange 12 as hereinbefore described, continued movement of the pull tab 14 from left to right as seen in FIG. 4 of the drawings and thence circumferentially of the closure on the neck portion of the container causes the tear skirt, which is the lower portion of the depending annular flange 12, to separate the connecting wall 19 where it is defined by the first annular groove 18 in the inner wall of the closure. The depending annular flange 12 below the first annular groove 18 is thus removed completely from the closure leaving the remaining portion of the closure as seen in FIG. 3, complete with its first fastening means intact upon the neck N of the container. The provision of the outturned flange 17 and the increased diameter of the annular depending flange 12 forms a convenient annular shoulder therebeneath which tapers upwardly and inwardly as best seen in FIG. 3 of the drawings which is particularly useful in removing the remaining portion of the closure from the neck N of the container as it permits a person's fingers to be positioned thereinunder and the edge of the closure lifted including the necessary distortion of the closure to free the inturned annular fastening flange 16 of the closure from its seat on the neck of the closure.

By referring again to FIG. 1 of the drawings, it will be seen that several circumferentially spaced angularly positioned ribs 26 are illustrated as being formed on the inner surface of the depending flange 12 of the closure and just below the first annular groove 18 which forms the frangible connecting wall 19 therein. These angularly disposed ribs 26 have two functions. When the closure is formed with these ribs 26, they serve to space the annular depending flange 12 at circumferentially spaced areas with respect to the annular flat wall 23 of the neck N of the closure and thus prevent distortion of the same with respect thereto. Secondly, the neck N of the container may be provided with matching rib-like configurations on the annular flat wall 23 as disclosed herein whereupon the ribs 26 may assist the removal of the closure from the neck N of the container by twisting the closure while simultaneously removing the tear skirt portion of the annular depending flange 12 thereof.

It will thus be seen that the tamper-proof closure for containers disclosed herein has several points of novelty with respect to the closures heretofore known in the art and in particular those which are primarily adapted for use on blow molded plastic jugs such as used in the dairy industry for the packaging of milk and similar liquid products.

Having thus disclosed my invention what I claim is:

1. An improvement in a resilient molded plastic closure for a container of the type having a neck surrounding an opening to the container and having dual closure, retaining means on the exterior of said neck; said closure comprising means for covering said opening to said container; said improvement comprising a first depending annular flange of a known diameter on said means for covering said opening to said container, said first annular depending flange having a lower edge, oppositely disposed outturned and inturned annular flanges on said lower edge, and a second depending annular flange of a larger diameter than said first depending annular flange on said outturned annular flange, said first and second depending annular flanges surrounding said neck, said inturned flange forming a first means for engaging one of said dual closure retaining means, an annular groove in said second depending annular flange forming a second means for engaging the other one of said dual closure retaining means spaced equally between said oppositely disposed outturned and inturned annular flanges and a lower edge of said second depending flange, an annular frangible wall formed in said second depending annular flange adjacent and below said outturned annular flange, a score line formed in said second depending annular flange and extending from said lower edge thereof to said annular frangible wall to define a tear skirt portion, said tear skirt portion having a pull tab affixed thereto, said dual closure retaining means on the exterior of said neck comprising an annular groove positioned for registry with said inturned annular flange and an annular rib positioned for registry with said annular groove in said second depending annular flange whereby the means for covering said opening to said container, the first depending annular flange, and the oppositely disposed outturned and inturned annular flanges on the lower edge of said first depending annular flange form an annular shoulder outwardly of said neck of said container enabling the same to be readily manually engaged for removing the closure.

2. The improvement in a closure for a container set forth in claim 1 and whereby a secondary depending annular flange is formed on said means covering said opening to said container and positioned inwardly of said first mentioned depending annular flange for registry with said neck.

3. The improvement in a closure for a container set forth in claim 1 and wherein said inturned annular flange and said annular groove in said closure are positioned for snap-in registry with said dual closure retaining means on said neck of said container when said closure is moved onto said neck.

* * * * *